US005444954A

United States Patent [19]

Anderson

[11] Patent Number: 5,444,954

[45] Date of Patent: Aug. 29, 1995

[54] DOOR MOLDINGS

[76] Inventor: Carl Anderson, 2589 Richmond Ter., Staten Island, N.Y. 10303

[21] Appl. No.: 104,288

[22] Filed: Aug. 11, 1993

[51] Int. Cl.[6] ..... E04F 19/02

[52] U.S. Cl. ..... 52/288.1; 52/211; 52/717.01; 52/718.04; 52/718.06

[58] Field of Search ..... 52/287.1, 288.1, 717.01, 52/718.04, 718.06, 211, 204.53, 287.1

[56] References Cited

U.S. PATENT DOCUMENTS

| | | | |
|---|---|---|---|
| 1,488,090 | 3/1924 | Buhr | 52/288.1 |
| 1,963,662 | 6/1934 | Knapp | 52/287.1 |
| 3,228,160 | 1/1966 | O'Brien | 52/287.1 |
| 3,408,250 | 10/1968 | Finefrock | 52/287.1 |
| 3,464,177 | 9/1969 | Amato | 52/718.04 |
| 3,473,278 | 10/1969 | Gossen | 52/288.1 |
| 4,004,381 | 1/1977 | Pichler et al. | 52/288.1 |
| 4,389,824 | 6/1983 | Anderson | 52/211 |
| 4,565,041 | 1/1986 | Wendt | 52/288.1 |
| 4,608,800 | 9/1986 | Fredette | 52/288.1 X |
| 5,018,325 | 5/1991 | Geen et al. | 52/211 |
| 5,022,204 | 6/1991 | Anderson | 52/211 |
| 5,222,343 | 6/1993 | Anderson | 52/288.1 X |
| 5,282,344 | 2/1994 | Moore | 52/717.01 |

*Primary Examiner*—Carl D. Friedman
*Assistant Examiner*—Laura A. Saladino
*Attorney, Agent, or Firm*—Helfgott & Karas

[57] ABSTRACT

A door and floor molding which includes a stationary piece and removable piece. When used as a door molding, the stationary piece is attached abutting a doorway or window and when used as a floor molding is attached a distance above the floor. The distance above the floor is dependent upon the width of the mid section of the removable piece. A lip of the removable piece extends above the mid section and is slideably engaged within a clamping pocket of the stationary piece. A stabilizing wall of the removable piece lies substantially perpendicular to the lip and extends on both sides of a plane of the lip. The stabilizing wall engages the wall in a manner so as to press the mid section against the stationary piece and provide a more secure fit. The removable piece may be removed from its position within the stationary piece to aid in painting around or running wires through the molding.

19 Claims, 3 Drawing Sheets

DOOR MOLDINGS

BACKGROUND OF THE INVENTION

1. Field of the Invention

This invention relates to door, floor and window moldings and surrounding for air conditioning units and, more particularly, to moldings having interlocking pieces which are easily separated.

2. Description of the Prior Art

Moldings for trimming around edges of doors, windows and base boards are generally well known. Presently, door moldings are made of either metal or wood. These moldings are usually solid blocks which, when attached to the wall, provide a flat, flush contact with the wall. These moldings are inflexible and not removable. When painting around such door or window moldings, a painter must very carefully tape the molding to paint the adjacent wall and then paint the molding separately. Likewise, when wallpapering the wall next to the molding, the paper must be carefully and exactly trimmed at the junction with the wood molding. Furthermore, if wires need to be laid in a room, these door, window and floor moldings are not accommodating for the wires. They cannot be removed to easily lay the wires behind them nor do they provide space behind them for the wires to be placed. Thus, typically, the wires are visibly attached at the wall adjacent the moldings.

It is known to use a flexible vinyl material as an exterior trim for windows and siding. For example, U.S. Pat. No. 4,389,824 dated Jun. 28, 1983 assigned to the present inventor, discloses an exterior door and window trim made of flexible vinyl known as polyvinylchloride (PVC). This patent discloses an elongated L-shaped panel which fits around the outside casing of a window or door. A facing strip having a receiving slot is provided for attachment to an inside face of the casing. The L-shaped panel is inserted into the receiving slot and then secured in place with fasteners. This is placed all around the exterior of a window or door. Similarly, U.S. Pat. No. 5,022,204 dated Jun. 11, 1991 and also assigned to the present inventor discloses an exterior trim for doors and windows using polyvinylchloride. This patent also discloses a receiving member formed with a folded hem, a receiving slot and a flat portion securable to the face of the outside of a window or door casing, and an L-shaped facing member inserted in the receiving slot. The L-shaped member is secured to the house. Application Ser. No. 07/695,299 filed May 5, 1991 also assigned to the present inventor discloses house trim panels for use with siding.

A need exists, though, for flexible pre-shaped moldings to be used for doors and floors inside houses and buildings. It may also be used for windows and to surround air conditioning units and the like. The molding should be both functional and decorative. It should be easily installed and accommodating for painting around and running wires through.

SUMMARY OF THE INVENTION

Accordingly, it is an object of the present invention to provide door, floor and window moldings and surrounding for air conditioning units and the like, having a decorative face which may be easily installed.

Another object of the present invention is to provide moldings having a stationary piece and a removable piece which are slideably engaged with each other.

A further object of the present invention is to provide moldings having a removable piece wherein there is provided a spaced cavity from the wall on which it is mounted for the insertion of wires to be run to a remote part of the room.

A still further object of the present invention is to provide moldings having a removable piece which may be detached to enable painting beneath the area covered by the piece and present the appearance of an evenly painted wall without the possibility of getting paint on the molding.

In brief, in accordance with the present invention, a door, window and floor molding and surrounding for air conditioning units and the like, is provided for use on walls inside a house or building. The molding comprises a stationary piece, which is secured to the wall, and a removable piece which is slideably engaged with the stationary piece. The stationary piece is provided with a flat back side for attachment to the wall from which is supported a clamping pocket.

The removable piece includes a lip section and a stabilizing wall section connected by a decorative mid section.

In operation, the stationary piece is secured to a wall at the appropriate position, dependent upon use as a floor, door, or window molding. The lip of the removable piece is slideably positioned to fit snugly in the clamping pocket. The stabilizing wall, in its engaged position, is pressed against the wall exerting a pressure on the wall. A pressure is exerted back on the stabilizing wall. This pressure provides an extra force to hold the pieces together. To remove the removable piece, one only needs to slide the lip out from its position in the clamping pocket. Since the pieces are made of flexible material, this is not difficult.

The aforementioned objects, features and advantages of the invention will, in part, become obvious from the following more detailed description of the invention, when taken in conjunction with the accompanying drawings, which form an integral part thereof.

DETAILED DESCRIPTION OF THE PREFERRED EMBODIMENT

Figure 1:
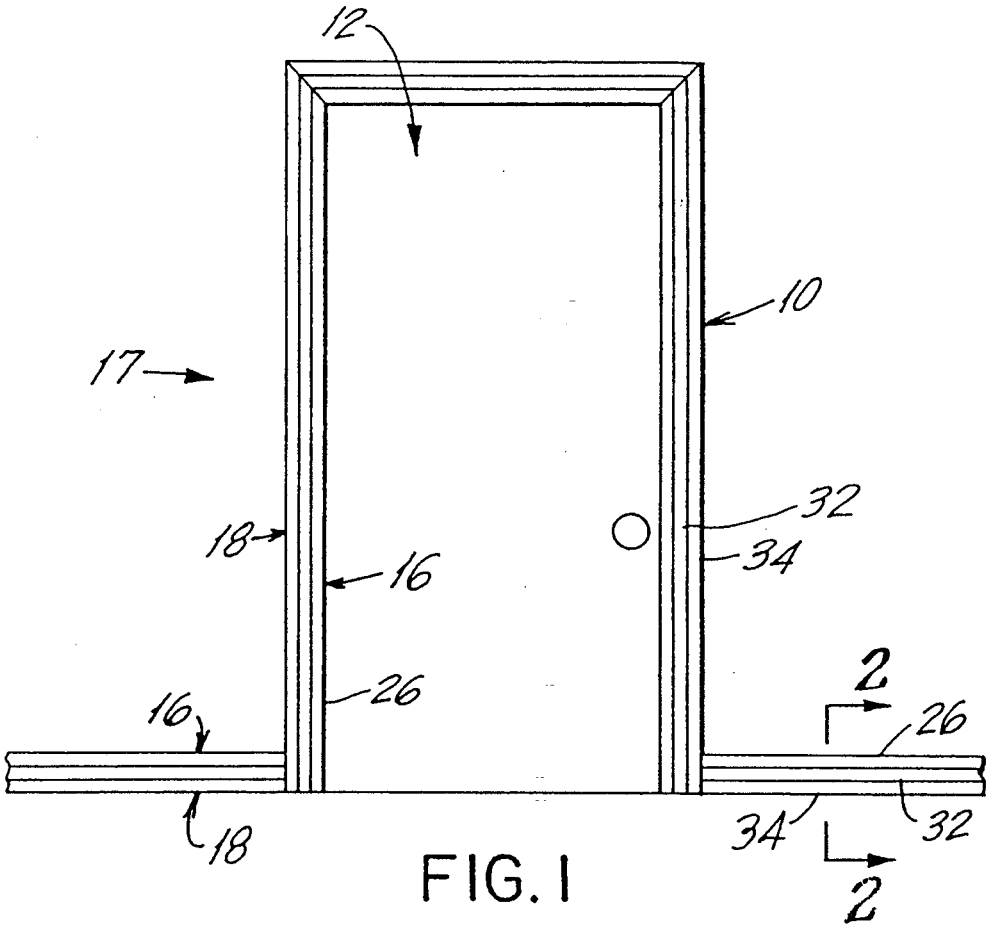
FIG. 1 is a front view of a door and wall incorporating the molding embodying the present invention.

Referring now to FIG. 1, there is shown a door 12 and a wall 14 of a room. Extending around the door 12 and along the base of the wall 14 are moldings 10. The moldings 10 are made of flexible, bendable polyvinylchloride (PVC) material. The type of PVC material used can be bent to form a permanent crease, without cracking. By way of example, PVC materials which can be used are a PVC film made by Nan Ya Plastics Corporation of Carteret, New Jersey designated "BWSBHXX" and PVC Compositions made by Occidental Chemical Corporation of Wayne, Pa. designated "OXYBLEND® 3773 PVC Compound" and "OXYBLEND® 3315 PVC White".

The molding 10 is composed of two separate and interlocking pieces. There is a stationary piece 16 and a removable piece 18.

Figure 4:
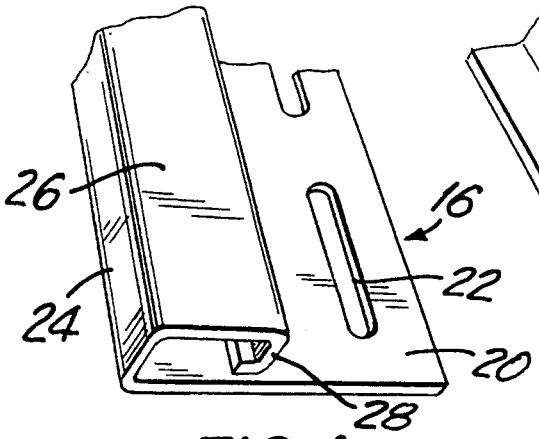
FIG. 4 is a perspective view of the face of the stationary piece of the present invention.
Figure 6:
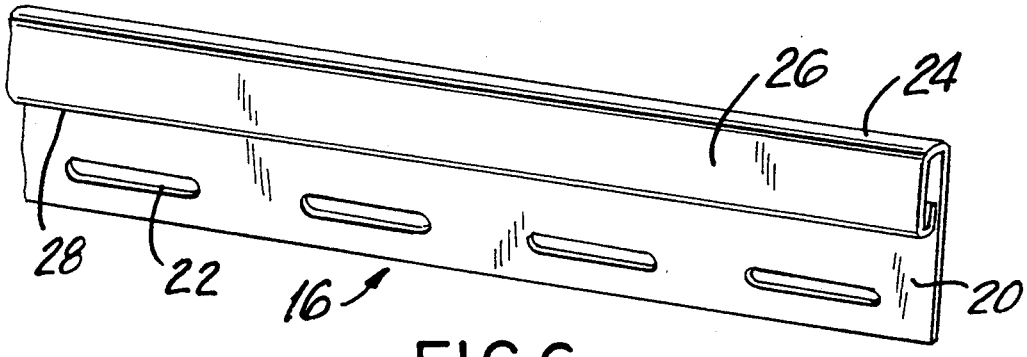
FIG. 6 is a view of the stationary piece of the present invention.

The stationary piece 16, as seen in FIGS. 4 and 6, has a flat back wall 20. The back wall 20 has holes 22 spaced apart along a lateral edge thereof. Attached to the edge of the back wall 20, opposite the holes 22, is a clamping pocket. In the Figures shown, the clamping pocket includes a side wall 24 attached to the edge of the back wall 20. The side wall 24 extends outward from the back wall 20 thereof at an angle of approximately 90°. Extending downward from the side wall 24 and along but spaced from the back wall 20 is a front wall 26. The front wall 26 extends angularly toward and along the back wall 20 a distance less than the width of the back wall 20. Extending inward from the front wall 26, towards the back wall 20, is a clamping wall 28. The clamping wall 28 extends toward, but is spaced from, the back wall 20 to define the clamping pocket. The base of the clamping wall may be rounded 44. This rounding of the clamping wall 28 is formed by an extension of the clamping wall 28 into the clamping pocket. The configuration of the clamping pocket described is for purposes of example only. Any functional and decorative shape may be employed in forming the clamping pocket.

Figure 5:
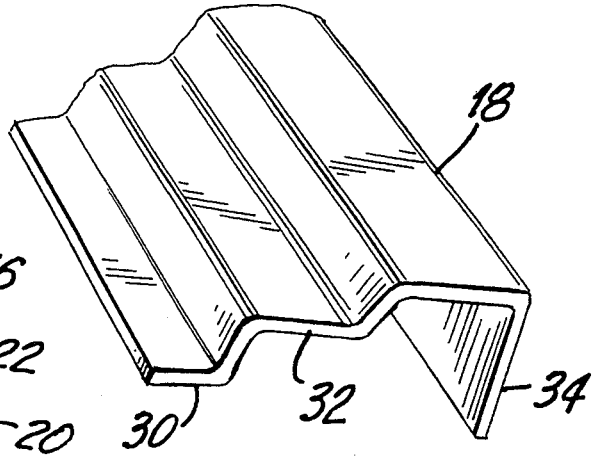
FIG. 5 is a perspective view of the face of the removable piece of the present invention.
Figure 7:
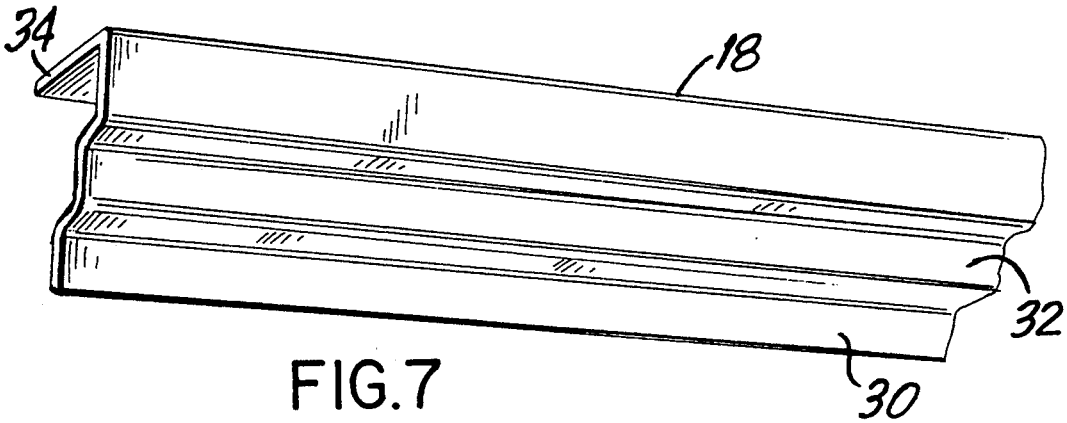
FIG. 7 is a view of the removable piece of the present invention.
Figure 10:
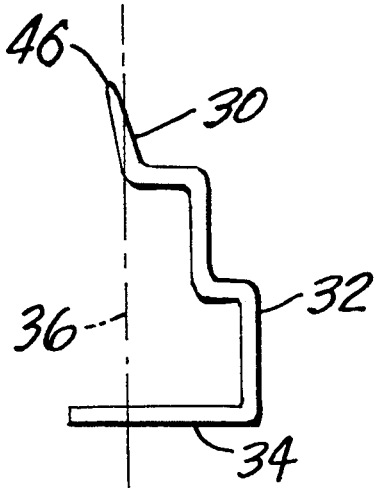
FIG. 10 is a side view of the removable piece of the present invention.

The removable piece 18, as illustrated in FIGS. 5 and 7, includes a lip 30, a mid section 32 and a stabilizing wall 34. The lip 30 is connected to the stabilizing wall 34 through the mid section 32. The lip 30 is also oriented substantially perpendicular to the stabilizing wall 34. It may be oriented at a slight angle from the perpendicular axis, away from the mid section 32. The lip 30 may also be shaped to come to a point at its free edge 46. The stabilizing wall 34 is of a length extending on either side of the plane 36 of the lip 30, as can be seen from FIG. 10. The mid section 32 can be of any functional and decorative shape. The shape of the mid section 32 illustrated in the drawings is for purposes of example.

Figure 8:
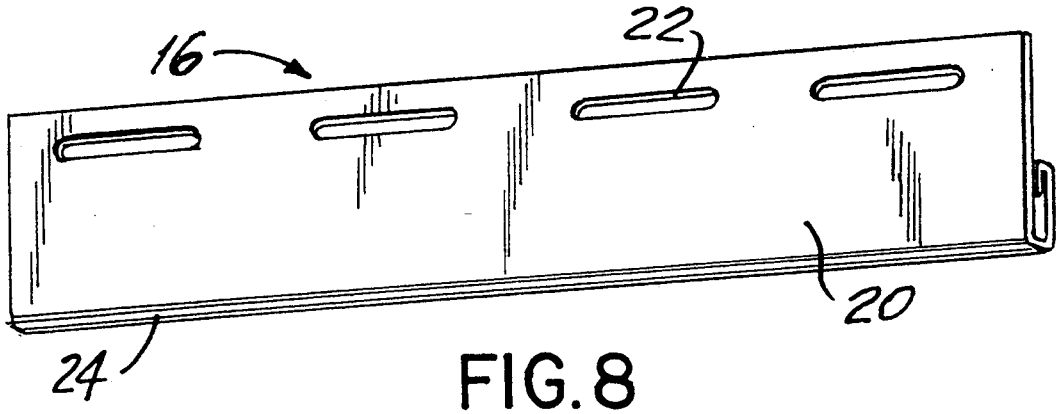
FIG. 8 is a view of the back of the stationary piece of the present invention.

FIG. 8 shows the back wall 20 of the stationary piece 16. The back wall 20 is flat to provide a smooth fit against a wall. The holes 22, used for attachment of the stationary piece 16, can also be seen as they extend through the back wall 20.

Figure 9:
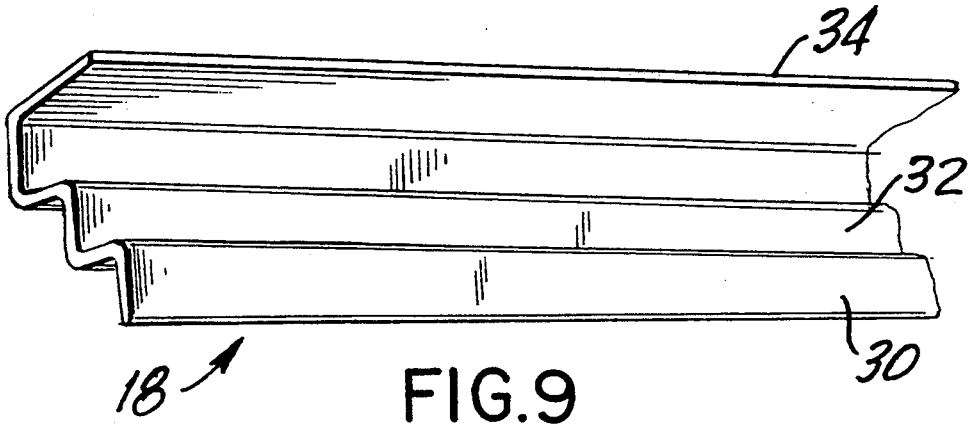
FIG. 9 is a view of the back of the removable piece of the present invention.

FIG. 9 illustrates the back of the removable piece 18. As can be seen, the mid section 32 is arced, providing a space between the mid section 32 and the wall to which the molding is attached. The mid section 32 may be of any decorative shape as long as it is spaced from the wall in its attached position. This space allows for the placement of wires between the wall and mid section 32, thus avoiding the possibility of the wires getting underfoot and also permits changing wires by simply removing the piece 18.

Both the stationary piece 16 and the removable piece 18 are made of bendable PVC. This provides for easy engagement and separability of the two pieces. The removable piece 18 can be more flexible than the stationary piece 16. This is due to the fact that when the PVC material is bent to form a permanent crease, some flexibility in that area of the material is lost. The stationary piece 16 is bent numerous times in a small area of the material to form the clamping pocket. These numerous creases limit the flexibility of the stationary piece 16. This limited flexibility provides a more stable and functional stationary piece 16. Since this piece will be secured to the wall it is not desirable for it to be bent or totally flexible. The only part of the stationary piece 16 which needs some limited flexibility is at the entrance to the clamping pocket. Flexibility at this point allows for easily connecting the stationary and removable pieces and a more snug fit between the pieces.

Figure 2:
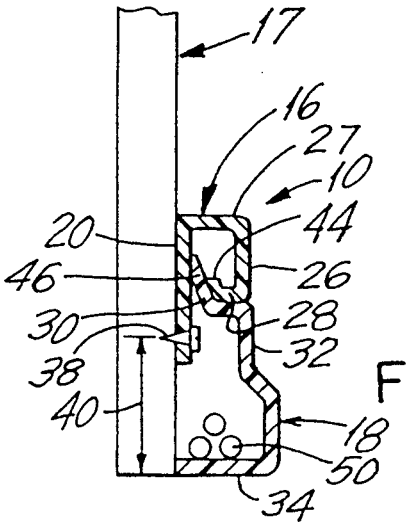
FIG. 2 is a view taken along the line 2—2 of FIG. 1.
Figure 3:
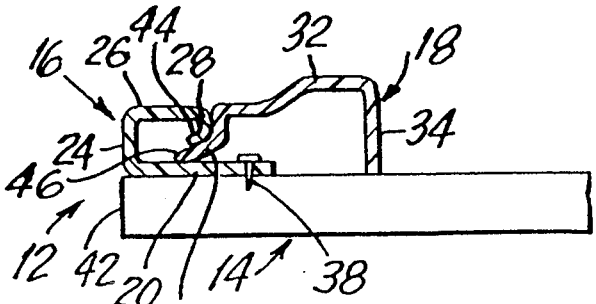
FIG. 3 is a view taken along the line 3—3 of FIG. 1.

In operation, the stationary piece 16 is secured in place by a securing device 38 such as tacks, nails or double sided tape. If tacks or nails 38 are used, for securing the stationary piece 16 to the wall, they are secured through the holes 22 provided on the back wall 20 of the stationary piece 16, as can be seen in FIGS. 2 and 3. When used as floor moldings, the stationary piece 16 is secured such that the side wall 24 is positioned flat against the floor with the junction between the back wall 20 and the side wall 24 positioned in the corner between the floor and wall, see FIG. 2. When used as door or window moldings, the stationary piece 16 is secured at a point at which the side wall 24 is even with the edge of the doorway 42 or window, as is seen from FIG. 3. The molding can also be positioned to surround an air conditioning unit. Once the stationary piece 16 is secured in place, the lip 30 of the removable piece 18 may be placed in the pocket formed between the clamping wall 28 and the back wall 20. Since the lip 30 is not as thick at its free end 46, it preferably comes to a point, and it slides into the clamping pocket more easily than if it were of a uniform thickness having a flat free end. The distance between the clamping wall 28 and the back wall 20 is small enough to provide a snug fit when the lip 30 is placed between them. The tapered end 44 of the clamping wall 28 adds to the secure fit of the two pieces and aids in placement of the lip 30 into the clamping pocket. The angle of the lip 30 further secures it in place by angling it so as to exert a pressure on the rounded edge 44. The lip 30 is further secured by pressure from the stabilizing wall 34. Because the stabilizing wall 34 extends out past the plane of the lip 30, a pressure is exerted on it by the wall 14. This pressure exerted on the stabilizing wall 34 is also exerted on the mid section 32. The mid section 32 is thus pressed against the clamping wall 28 providing further pressure against the clamping wall 28 and on the lip 30, causing the lip 30 to be further angled away from the rounded end 44 of the clamping wall 28. The presence of this angle from the perpendicular axis on the lip 30 causes a pressure to be exerted upward on the clamping wall 28 by the lip 30. The clamping wall 28, due to its having less flexibility than the lip 30, exerts an opposite pressure down on the lip 30. These forces acting on the lip 30 and clamping wall 28 aid in holding the lip 30 more securely in place.

To separate the two pieces, the removable piece 18 is simply slid out of its position between the clamping side 28 and the back side 20 of the stationary piece 16. The flexibility of the molding makes it easier to separate the two pieces by bending of the removable piece by the person separating the molding.

Having a space between the wall 14 to which the molding is attached and the mid section 32 of the removable piece 18 allows for neatly wiring a room. All that need be done is to remove the removable piece 18 and place the wires 50, as shown in FIG. 2, between the removable piece 18 and the wall 14. Then the removable piece 18 is replaced in its position having a snug connection within the clamping pocket of the stationary piece 16. The wires 50 are now hidden from site and prevented from extending out into the room or doorway into the path of passersby.

These moldings 10 are also helpful in creating neatly painted edges around door, window and floor areas and surrounding air conditioning units. When painting near the molding simply remove the removable piece 18 and paint beneath the area it covers. When the paint is dry, replace the removable piece 18. The area around the molding is therefore painted up to and beneath the molding without paint getting on the molding.

Although these moldings have been described primarily for use indoors, they are also functional for use outside as moldings and trim on houses.

There has been disclosed, heretofore, the best embodiment of the invention presently contemplated. However, it is to be understood that various changes and modifications may be made thereto without departing from the spirit and scope of the invention.

What is claimed is:

1. Door, window, floor molding and the like for attachment with a structure wall, comprising:

a stationary piece for attachment to the structure wall, including:

a back wall for positioning against and attachment to the structure wall; and a clamping section attached at a first end to and extending from and overlying the back wall on a side opposite the attachment to the structure wall whereby a clamping pocket is formed between the clamping section and the back wall; and a removable piece including:

a lip section;

a stabilizing wall; and a mid section connecting the lip section and stabilizing wall, wherein the lip section is slideably and removably positioned within the clamping pocket of the stationary piece.

2. The molding of claim 1, wherein the stationary piece and removable piece are made of flexible polyvinylchloride.

3. The molding of claim 1, wherein the clamping section includes:

a side wall attached, at a first side, to the first end of the back wall and extending outward therefrom; a front wall extending outward from a second side of the side wall and along but separated from the back wall; and a clamping wall attached to the front wall, extending between the front wall and back wall, and spaced from the back wall.

4. The molding of claim 3, wherein the clamping wall is rounded at a free end thereof.

5. The molding of claim 3, wherein the front wall is angled toward the back wall.

6. The molding of claim 3, wherein the stationary piece is able to be secured a distance above a base of the structure wall and the back wall is adapted to be flush against the structure wall when used as a floor molding.

7. The molding of claim 6, wherein double sided tape is placed on the back wall for securing the stationary piece to the structure wall.

8. The molding of claim 6, wherein the back wall of the stationary piece has a plurality of holes, on a second end thereof, and a plurality of fasteners are able to be placed into the structure wall through respective ones of the plurality of holes, for securing the stationary piece to the structure wall.

9. The molding of claim 1, wherein the lip section lies substantially perpendicular to the stabilizing wall.

10. The molding of claim 1, wherein the lip section is not of uniform thickness, coming to a point at a free end thereof ensuring easier positioning within the clamping pocket.

11. The molding of claim 1, wherein the stabilizing wall extends on both sides of a plane of the lip section.

12. The moldings of claim 1, wherein a space exists behind the mid section upon its attachment to the structure wall.

13. The moldings of claim 12, wherein wires extending into a room are placed in said space.

14. The molding of claim 1, wherein the lip section is able to be removed from its position within the clamping pocket, providing for neat and easy painting without getting paint on the molding.

15. The molding of claim 1, wherein the stationary piece is able to be secured at a point even with an edge of the structure wall when used as one of a door and window molding.

16. The molding of claim 15, wherein double sided tape is placed on the back wall for securing the stationary piece to the structure wall.

17. The molding of claim 15, wherein the back wall of the stationary piece has a plurality of holes, on a second end thereof, and a plurality of fasteners are able to be placed into the structure wall through respective ones of the plurality of holes, for securing the stationary piece to the structure wall.

18. Door, window, floor molding and the like, comprising:

a stationary piece for attachment to a structure wall, including:

a back wall for positioning against and attachment to the structure wall; and a clamping pocket extending outward from the back wall on a side opposite the side for attachment to the structure wall; and a removable piece including:

a lip section;

a stabilizing wall; and a mid section connecting the lip section and stabilizing wall, wherein the lip section is slideably and removably positioned within the clamping pocket of the stationary piece and wherein the clamping pocket includes:

a side wall attached, at a first side, to a first end of the back wall and extending outward therefrom;

a front wall extending outward from a second side of the wall and along but separated from the back wall; and a clamping wall attached to the front wall, extending between the front wall and back wall, and spaced from the back wall.

19. Door, window, floor molding and the like, comprising:

a stationary piece, including:

a back wall; and a clamping section attached at a first end to and extending from and overlying the back wall whereby a clamping pocket is formed between the clamping section and the back wall; and a removable piece including:

a lip section;

a stabilizing wall; and a mid section connecting the lip section and stabilizing wall, wherein the lip section is slideably and removably positioned within the clamping pocket of the stationary piece.

* * * * *